US007077465B1

(12) United States Patent
Calderon

(10) Patent No.: US 7,077,465 B1
(45) Date of Patent: Jul. 18, 2006

(54) COMBINED CHAIR AND WATER-MISTING APPARATUS

(76) Inventor: Michael D. Calderon, 640 Mansfield Village, Hackettstown, NJ (US) 07840

( * ) Notice: Subject to any disclaimer, the term of this patent is extended or adjusted under 35 U.S.C. 154(b) by 0 days.

(21) Appl. No.: 10/984,657

(22) Filed: Nov. 10, 2004

(51) Int. Cl.
*A47C 7/72* (2006.01)

(52) U.S. Cl. ..... 297/180.15; 297/217.3

(58) Field of Classification Search ..... 297/180.15, 297/217.3, 217.1; 239/289; 4/567, 568, 4/615, 616
See application file for complete search history.

(56) References Cited

U.S. PATENT DOCUMENTS 3,625,434 A 12/1971 Kitover
4,765,542 A 8/1988 Carlson
4,846,525 A 7/1989 Manning
4,854,502 A * 8/1989 Cox ..... 239/124
5,000,384 A 3/1991 Arnold
5,330,104 A 7/1994 Marcus
5,387,181 A * 2/1995 Olsen ..... 601/155
D362,555 S 9/1995 Andrews
5,613,731 A * 3/1997 Aspinall ..... 297/180.15
5,823,617 A 10/1998 Schafer
6,089,655 A * 7/2000 Colman ..... 297/180.15

* cited by examiner

*Primary Examiner*—Peter R. Brown
*Assistant Examiner*—Joe Edell

(57) ABSTRACT

A chair for providing comfort to a user in inclement weather conditions includes seat and back sections with isolated first and second cavities. The first cavity contains a volume of water. A power mechanism includes a pump and conduits for retrieving water from the first cavity and directing same along the second cavity towards misting heads on the top of the back section. The power mechanism includes an internal power supply source and a switch. An elongated drain tube allows a user to release the water housed within the first cavity.

12 Claims, 4 Drawing Sheets

COMBINED CHAIR AND WATER-MISTING APPARATUS

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a lawn chair and, more particularly, to a lawn chair including an apparatus for spraying a sunbather with water.

2. Prior Art

Leisure in the sun involves anything from sunbathing for the purpose of tanning to napping or resting outdoors while exposed to the sun. However, one either perspires in the heat of the sun or, at the other extreme, dehydrates one's exposed skin. At either extreme, a refreshing spray of water is often needed. The many attempts to obtain such a spray have been complicated by considerations of construction integrity, the aesthetics of sun lounging chairs, and hydraulic engineering to obtain a water tight pressure system.

Lounge furniture should be low cost, ergonomically adjustable, aesthetically pleasing, capable of withstanding hard outdoor use and even abuse, lightweight, and easily transported and stored. This has been achieved in the simple sun lounge, but is not generally available in spray or misting lounge.

Previously, it has been known to incorporate a water spray device in conjunction with a chair. The structures of these patents do provide for a water spray that is to be applied to the sunbathing individual and this water spray does alleviate the problem of the individual overheating. However, the adjustability of the nozzles to direct the flow of the water is minimal. Adjustability of the nozzles is important as individuals greatly vary in size and in shape.

It is clear there have been attempts to provide portable sunbathing apparatuses having cooling means for sunbathers in the past. However, it is known that many people sunbathe at beaches, parks and other locations where water supply hoses and electric extension cords are not available for use by the public. Several of the patented devices rely on such hoses and cords to assist in cooling the sunbather. Although other devices shown were somewhat less reliant on such hookups, the sunbather would still be required to find a sometimes large supply of fresh water and haul it in containers or other means to fill the device. Fresh water is not always readily obtainable on ocean beaches, consequently a sunbather may have to choose between soaking in salt water, hauling heavy containers of water, or not using the cooling feature of the device at all.

Accordingly, a need remains for an outdoor lounge chair including a spray device. The present invention satisfies such a need by providing a battery powered pump mechanism which reuses a water supply to spray a sunbather in the hot outdoors. This feature allows the present invention to be used at the beach or park. Additionally, the reflecting water on the sunbather would enhance a user's tan.

BRIEF SUMMARY OF THE INVENTION

In view of the foregoing background, it is therefore an object of the present invention to provide user comfort in inclement outdoor environments. These and other objects, features, and advantages of the invention are provided by a chair including integrally disposed seat and back sections for defining a surface area onto which a user may sit and recline respectively. Such seat and back sections further define first and second isolated cavities that have lower and upper portions wherein the lower portions are positioned along a substantially horizontally plane and the upper portions extend upwardly therefrom at an oblique angle offset from a vertical plane. The first cavity is formed from impermeable material for containing a predetermined volume of water therein. Such a chair further includes a plurality of arm rests connected to the back section and extending forwardly therefrom.

Advantageously, a power mechanism selectively dispenses water mist outwardly and away from a selected region of the back section so that water can be deposited onto at least one portion of a user's body while seated on the chair. The power mechanism preferably includes a pump secured to the back section and situated rearwardly thereof. The power mechanism may further include a plurality of conduits for retrieving water from the first cavity and directing same upwardly along the second cavity towards a top end portion of the back section respectively.

Furthermore, the power mechanism may include a plurality of misting heads laterally spaced along the top end portion of the back section for ejecting water forwardly therefrom. The misting heads are preferably disposed parallel to the horizontal plane. The power mechanism preferably includes an internal power supply source and a switch so that a user may selectively toggle the power mechanism between operating and non-operating modes.

An elongated drain tube having a centrally disposed longitudinal axis extends parallel to the vertical plane and upper and lower end portions. Such a drain tube is in fluid communication with the first cavity and exterior of the second cavity respectively and allows a user to selectively release the water housed within the first cavity while maintaining the second cavity at a substantially non-aqueous state. The upper end portion of the drain tube is provided with a plurality of apertures for accepting water therethrough while the lower end portion of the drain tube has a threaded outer surface and is provided with an end cap removably securable thereto. Such an end cap has a rubber seal positioned along a bottom surface thereof for preventing water from seeping out of the drain tube during operating conditions.

BRIEF DESCRIPTION OF THE SEVERAL VIEWS OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
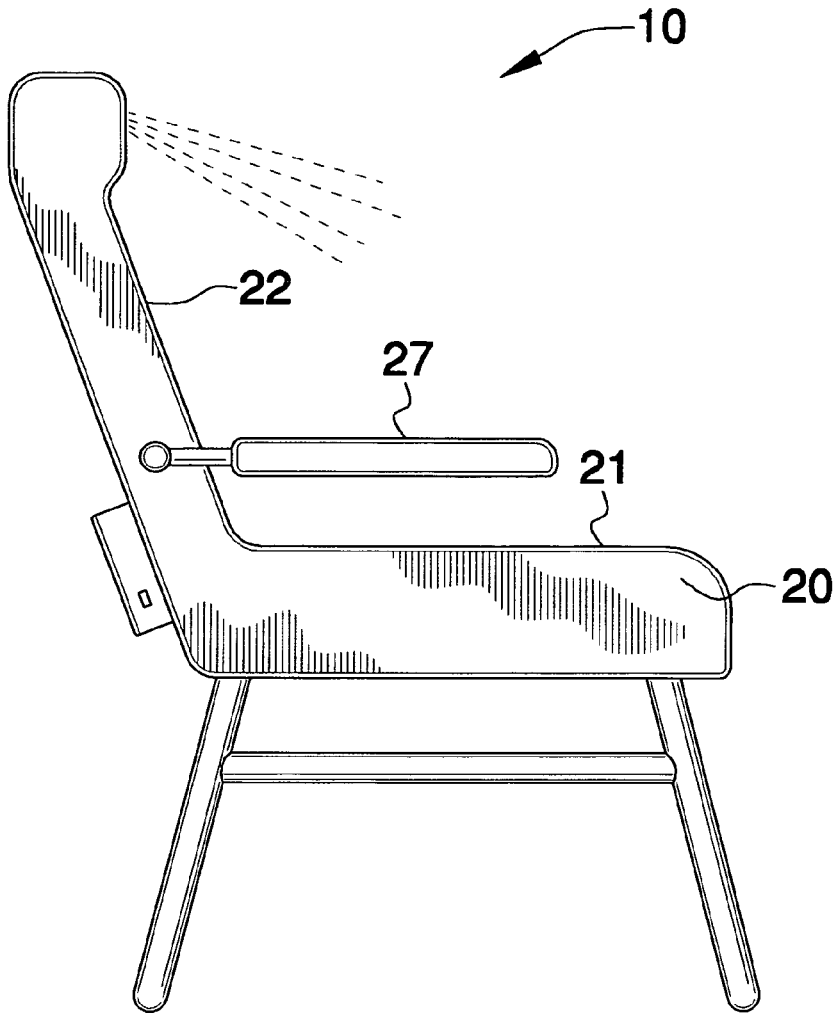
FIG. 1 is a side elevational view showing a lawn chair including a spraying mechanism for cooling a user, in accordance with the present invention.
Figure 2:
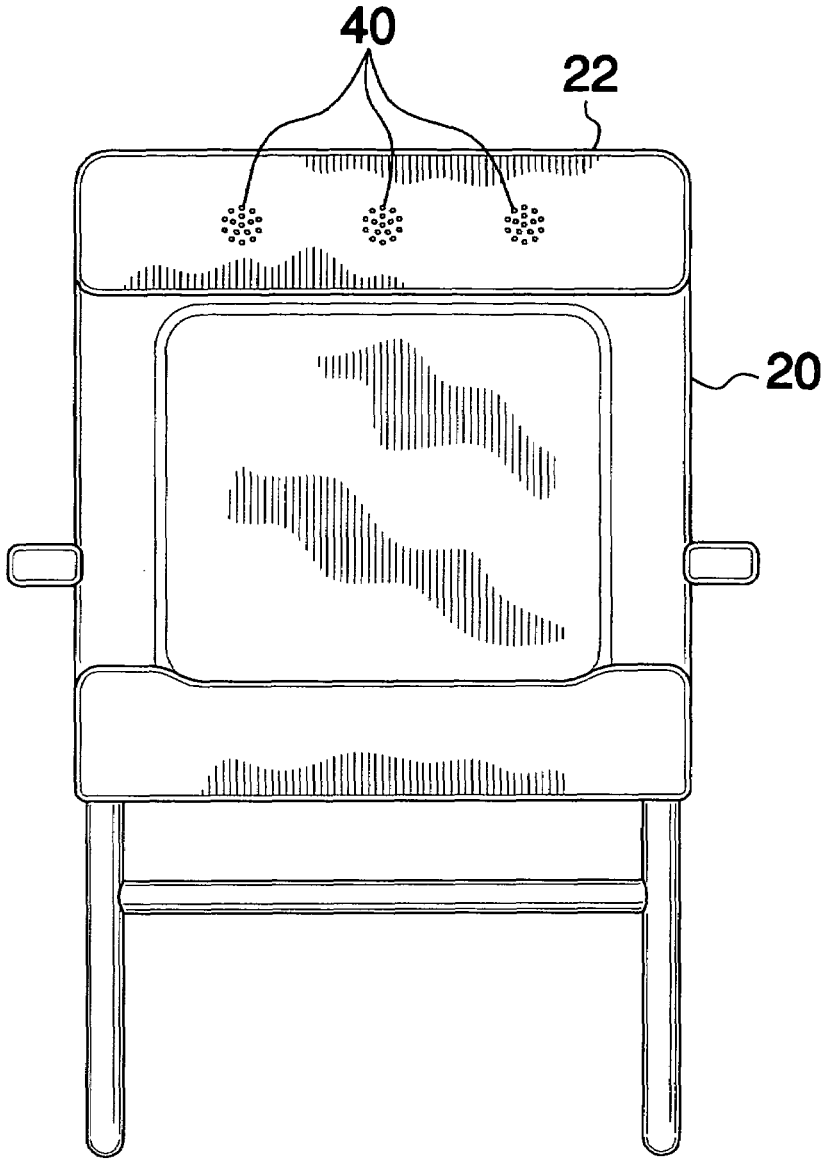
FIG. 2 is a front elevational view showing the present invention of FIG. 1.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1–4 by the reference numeral 10 and is intended to provide relief from the heat and a comfortable place to sit in the hot outdoors. It should be understood that the apparatus 10 may be used in a variety of outdoor locations by people of all ages and body types.

Figure 3:
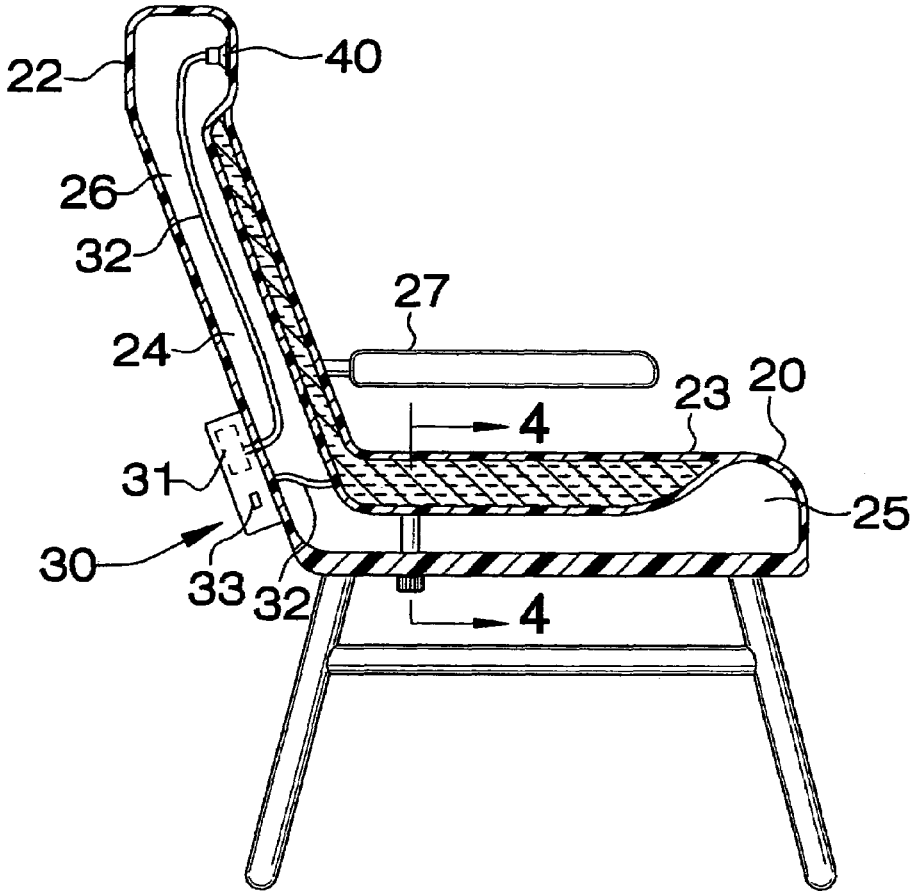
FIG. 3 is a cross-sectional view showing the pump mechanism of the present invention shown in FIG. 1.

Referring initially to FIGS. 1 and 3, the apparatus 10 includes a chair 20 having integrally disposed seat 21 and back 22 sections for defining a surface area onto which a user may sit and recline respectively. Such seat 21 and back 22 sections further define first 23 and second 24 isolated cavities that have lower 25 and upper 26 portions wherein the lower portions 25 are positioned along a substantially horizontally plane and the upper portions 26 extend upwardly therefrom at an oblique angle offset from a vertical plane. The first cavity 23 is formed from impermeable material for containing a predetermined volume of water therein. Such a chair 20 further includes a plurality of arm rests 27 connected to the back section 22 and extending forwardly therefrom.

Still referring to FIG. 3, a power mechanism 30 selectively dispenses water mist outwardly and away from a selected region of the back section 22 so that water can be deposited onto at least one portion of a user's body while seated on the chair 20. The power mechanism 30 preferably includes a pump 31 secured to the back section 22 and situated rearwardly thereof. The power mechanism 30 may further include a plurality of conduits 32 for retrieving water from the first cavity 23 and directing same upwardly along the second cavity 24 towards a top end portion of the back section 22 respectively.

The power mechanism 30 gives a user the opportunity to reuse the same water supply instead of having to hook the chair up to a hose or carry heavy buckets of water to and from the chair. Furthermore, the power mechanism 30 includes a plurality of misting heads 40 laterally spaced along the top end portion of the back section 22 for ejecting water forwardly therefrom. The misting heads 30 are preferably disposed parallel to the horizontal plane, best shown in FIG. 2. The power mechanism 30 preferably includes an internal power supply source (not shown) and a switch 33 so that a user may selectively toggle the power mechanism 30 between operating and non-operating modes.

Figure 4:
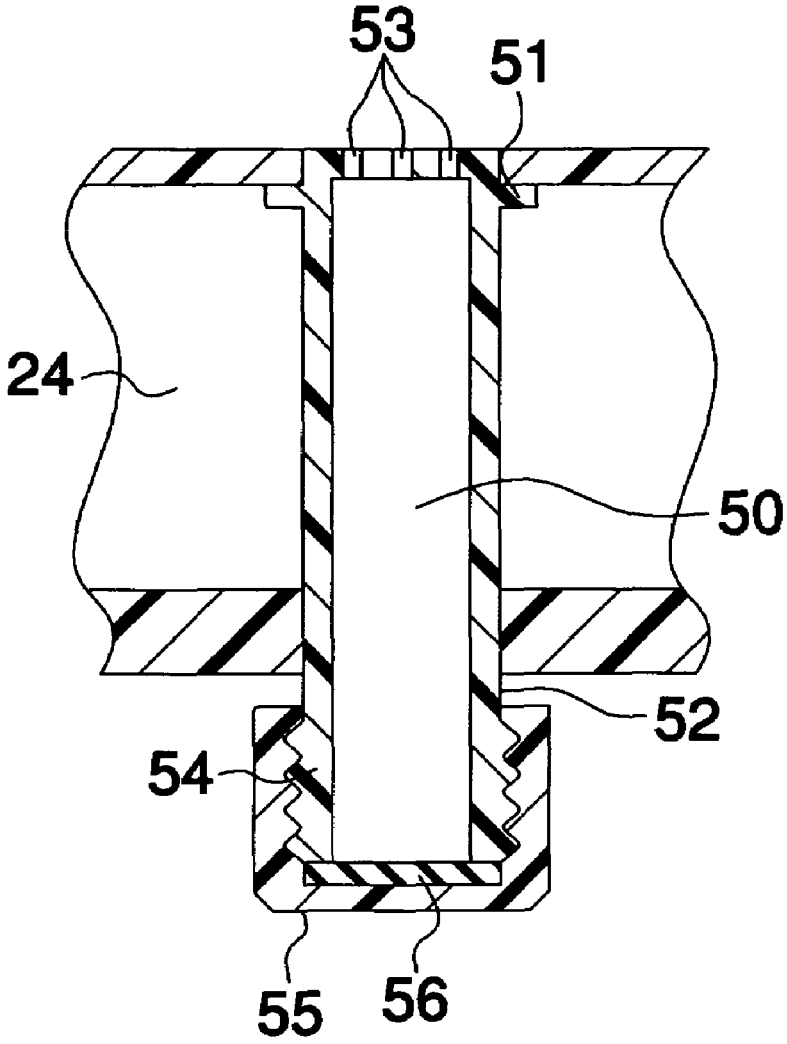
FIG. 4 is an enlarged cross-sectional view of the drain tube shown in FIG. 3, taken along line 4—4.

Now referring to FIG. 4, an elongated drain tube 50 having a centrally disposed longitudinal axis extends parallel to the vertical plane and has upper 51 and lower 52 end portions. Such a drain tube 50 is in fluid communication with the first cavity 23 and the exterior of the second cavity 24 respectively and allows a user to selectively release the water housed within the first cavity 23 while maintaining the second cavity 24 at a substantially non-aqueous state. The upper end portion 51 of the drain tube 50 is provided with a plurality of apertures 53 for accepting water therethrough while the lower end portion 52 of the drain tube has a threaded outer surface 54 and is provided with an end cap 55 removably securable thereto. Such an end cap 55 has a rubber seal 56 positioned along a bottom surface thereof for preventing water from seeping out of the drain tube 50 during operating conditions.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An apparatus for providing user comfort in inclement outdoor environments, said apparatus comprising:

a chair including integrally disposed seat and back sections for defining a surface area onto which a user may sit and recline respectively, said seat and back sections further defining first and second isolated cavities having lower and upper portions wherein said lower portions are positioned along a substantially horizontally plane and said upper portions extends upwardly therefrom at an oblique angle offset from a vertical plane, said first cavity for containing a predetermined volume of water therein;

means for selectively dispensing water mist outwardly and away from a selected region of said back section so that water can be deposited onto at least one portion of a user's body while seated on said chair; and an elongated drain tube having a centrally disposed longitudinal axis extending parallel to the vertical plane and having upper and lower end portions in fluid communication with said first cavity and exterior of said second cavity respectively, said drain tube for allowing a user to selectively release the water housed within the first cavity while maintaining said second cavity at a substantially non-aqueous state, said upper end portion of said drain tube being provided with a plurality of apertures for accepting water therethrough, said lower end portion of said drain tube having a threaded outer surface and being provided with an end cap removably securable thereto, said end cap having a rubber seal positioned along a bottom surface thereof for preventing water from seeping out of said drain tube during operating conditions.

2. The apparatus of claim 1, wherein said means for dispensing comprises:

a pump secured to said back section and situated rearwardly thereof;

a plurality of conduits for retrieving water from said first cavity and directing same upwardly along the second cavity towards a top end portion of said back section respectively; and a plurality of misting heads laterally spaced along said top end portion of said back section for ejecting water forwardly therefrom.

3. The apparatus of claim 1, wherein said means for dispensing further comprises: an internal power supply source and a switch so that a user may selectively toggle said means for dispensing between operating and non-operating modes.

4. The apparatus of claim 1, wherein said misting heads are disposed parallel to the horizontal plane.

5. An apparatus for providing user comfort in inclement outdoor environments, said apparatus comprising:

a chair including integrally disposed seat and back sections for defining a surface area onto which a user may sit and recline respectively, said seat and back sections further defining first and second isolated cavities having lower and upper portions wherein said lower portions are positioned along a substantially horizontally plane and said upper portions extends upwardly therefrom at an oblique angle offset from a vertical plane, said first cavity for containing a predetermined volume of water therein, said chair further including a plurality of arm rests connected to said back section and extending forwardly therefrom; and means for selectively dispensing water mist outwardly and away from a selected region of said back section so that water can be deposited onto at least one portion of a user's body while seated on said chair; and an elongated drain tube having a centrally disposed longitudinal axis extending parallel to the vertical plane and having upper and lower end portions in fluid communication with said first cavity and exterior of said second cavity respectively, said drain tube for allowing a user to selectively release the water housed within the first cavity while maintaining said second cavity at a substantially non-aqueous state, said upper end portion of said drain tube being provided with a plurality of apertures for accepting water therethrough, said lower end portion of said drain tube having a threaded outer surface and being provided with an end cap removably securable thereto, said end cap having a rubber seal positioned along a bottom surface thereof for preventing water from seeping out of said drain tube during operating conditions.

6. The apparatus of claim 5, wherein said means for dispensing comprises:

a pump secured to said back section and situated rearwardly thereof;

a plurality of conduits for retrieving water from said first cavity and directing same upwardly along the second cavity towards a top end portion of said back section respectively; and a plurality of misting heads laterally spaced along said top end portion of said back section for ejecting water forwardly therefrom.

7. The apparatus of claim 5, wherein said means for dispensing further comprises: an internal power supply source and a switch so that a user may selectively toggle said means for dispensing between operating and non-operating modes.

8. The apparatus of claim 5, wherein said misting heads are disposed parallel to the horizontal plane.

9. An apparatus for providing user comfort in inclement outdoor environments, said apparatus comprising:

a chair including integrally disposed seat and back sections for defining a surface area onto which a user may sit and recline respectively, said seat and back sections further defining first and second isolated cavities having lower and upper portions wherein said lower portions are positioned along a substantially horizontally plane and said upper portions extends upwardly therefrom at an oblique angle offset from a vertical plane, said first cavity being formed from impermeable material for containing a predetermined volume of water therein, said chair further including a plurality of arm rests connected to said back section and extending forwardly therefrom;

means for selectively dispensing water mist outwardly and away from a selected region of said back section so that water can be deposited onto at least one portion of a user's body while seated on said chair; and an elongated drain tube having a centrally disposed longitudinal axis extending parallel to the vertical plane and having upper and lower end portions in fluid communication with said first cavity and exterior of said second cavity respectively, said drain tube for allowing a user to selectively release the water housed within the first cavity while maintaining said second cavity at a substantially non-aqueous state, said upper end portion of said drain tube being provided with a plurality of apertures for accepting water therethrough, said lower end portion of said drain tube having a threaded outer surface and being provided with an end cap removably securable thereto, said end cap having a rubber seal positioned along a bottom surface thereof for preventing water from seeping out of said drain tube during operating conditions.

10. The apparatus of claim 9, wherein said means for dispensing comprises:

a pump secured to said back section and situated rearwardly thereof;

a plurality of conduits for retrieving water from said first cavity and directing same upwardly along the second cavity towards a top end portion of said back section respectively; and a plurality of misting heads laterally spaced along said top end portion of said back section for ejecting water forwardly therefrom.

11. The apparatus of claim 9, wherein said means for dispensing further comprises: an internal power supply source and a switch so that a user may selectively toggle said means for dispensing means between operating and non-operating modes.

12. The apparatus of claim 9, wherein said misting heads are disposed parallel to the horizontal plane.

* * * * *